United States Patent [19]

Edmé et al.

[11] Patent Number: 4,525,705

[45] Date of Patent: Jun. 25, 1985

[54] SYSTEM FOR DETECTING THE PRESENCE OF A YARN ON A CONTINUOUS SPINNING FRAME

[75] Inventors: Jacques Edmé, Sainghin en Melantois; Etienne Deffontaine, Ennevelin, both of France

[73] Assignees: Centre Technique Industriel Dit: Insttiut Textile de France, Boulogne Billancourt; Establissement Public Dit: Agence Nationale de Valorisation de la Recherche (Anvar), Paris, both of France

[21] Appl. No.: 395,359

[22] Filed: Jul. 6, 1982

[30] Foreign Application Priority Data

Jul. 6, 1981 [FR] France ..... 81 13274

[51] Int. Cl.[3] ..... D03D 51/28

[52] U.S. Cl. ..... 340/677; 28/187; 66/163

[58] Field of Search ..... 340/677; 66/163; 28/187

[56] References Cited

U.S. PATENT DOCUMENTS

| | | | |
|---|---|---|---|
| 1,970,264 | 8/1934 | Welch et al. | 28/187 |
| 2,450,996 | 10/1948 | Seney | 28/187 |
| 3,723,990 | 3/1973 | Paul | 340/677 |

*Primary Examiner*—Howard A. Birmiel
*Attorney, Agent, or Firm*—Louis E. Marn

[57] ABSTRACT

The system according to the invention comprises a sensor composed of a movable unit formed by an electrical circuit in which are placed two supple blade switches closed by a rocking member in response to the presence of a yarn. Said circuit comprises a conductor wound on a magnetic core. The data transmitting device comprises a fixed looped conductor of which one part is parallel to the path followed by the sensor and traverses the core. Means are provided for generating oscillations in the looped conductor, as well as means for detecting a variation in the oscillating conditions induced by a change of state of the electrical circuit due to the closure of one switch and indicating that the sensor has met up with a yarn. Due to the detection of the variations in the oscillating conditions, it is possible to find out the number of breakages occurring in the textile machine.

10 Claims, 6 Drawing Figures

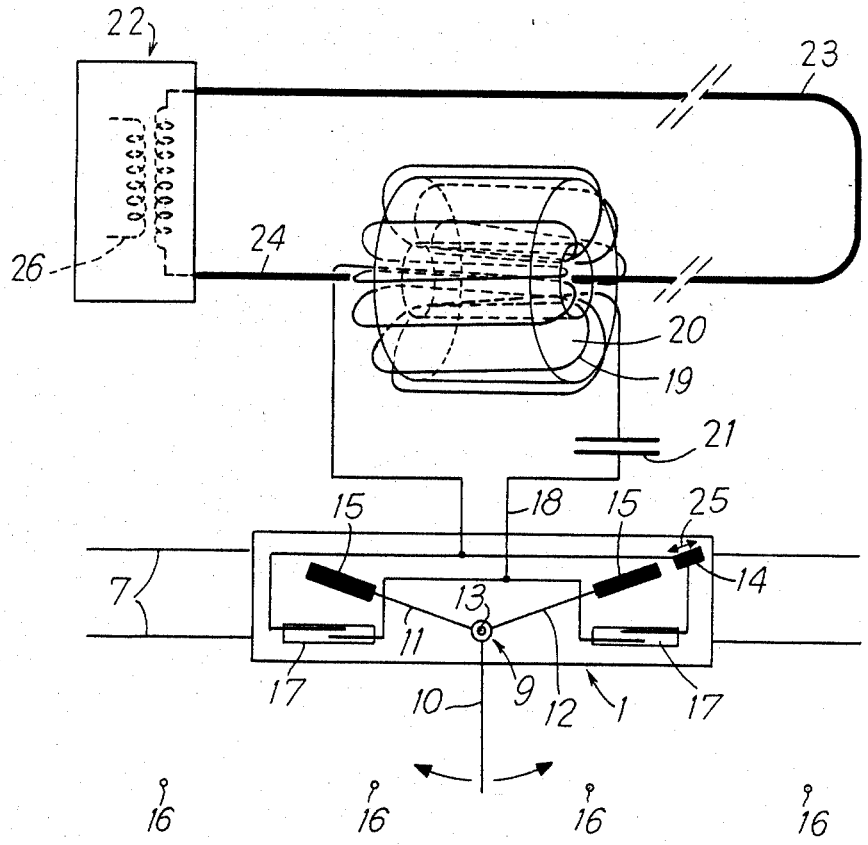
FIG. 1
FIG. 2
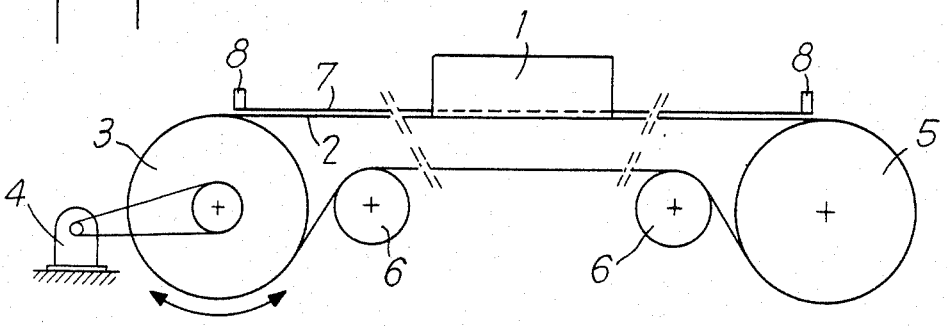

SYSTEM FOR DETECTING THE PRESENCE OF A YARN ON A CONTINUOUS SPINNING FRAME

The present invention relates to a system for detecting the presence of yarns on a textile machine of the type comprsing a moving sensor detecting the presence of a yarn and converting this presence into electrical data, means for driving the sensor and means for conveying the data towards a stationary data processing unit.

These types of detection are known, for example, from French Pat. No. 2 002 208. Generally speaking, these systems are more particularly designed to detect the presence (or the absence) of a yarn on a textile tmachine such as a continuous spinning frame using remote-detection means, and in particular photoelectric and electroacoustic means. Said latter are delicate to use and to control accurately, they also often require an electrical supply which moves with the sensor, this raising connection problems.

In is a particular object of the present invention to propose a detection system wherein the sensor can dispense with electrical supply, whilst of course preserving the transmission and detection of the electrical data corresponding to the presence of a yarn.

This object is reached in that the sensor comprises a movable unit composed of an electrical circuit in which is placed at least one switch, the change in state of which indicates that the sensor has met up with a yarn whilst on its course, the said electrical circuit being constituted by winding of a conductor about a cylindrical magnetic core integral with the sensor and, in that the data conveyor means comprises a fixed looped conductor of which one part is parallel to the path followed by the sensor and traverses the magnetic core, oscillation-generating means being provided to generate oscillations in the looped conductor as well as electronic means for detecting a variation of the oscillation conditions, induced by a change of state of the sensor electrical circuit.

The change of state of the electrical circuit can be the closing or opening of said circuit in response to the detection of a yarn depending on the disposition of the sensor. This detection can be made by different means.

It has been found that detection of the presence of a yarn by contact is one of the most reliable means of detection. However, it is absolutely necessary that this detection should take place without actually influencing the formation of the yarns, a condition which, up to now, has never been really satisfactorily met by the known contact detection devices, such as that described in French Pat. No. 2 002 208.

It is a further object of the invention to propose a new detection system of the aforesaid type, wherein the contact detection means act very smoothly and with great suppleness, so as to have no influence on the formation of yarns.

To this effect, the sensor is composed of a rocking member pivoting about a vertical axis, said rocking member comprising a horizontal sensing rod subjected to the action of magnetic return means tending to return it towards a balanced position from which it is able to move away when meeting up with a yarn whilst the sensor is moving, said rocking member further comprising at least a magnet which cooperates with the knife switch or switches equipped with supple blades and is placed in the electrical circuit of the sensor in such a way that if the sensing rod moves slightly away from its balanced position, this causes a change of state for the knife switch and for the electrical circuit, this indicating the presence of a yarn.

The change of state of the switch (and hence of the circuit) can mean the closing or the opening of the switch depending on whether the sensor is so designed that the rocking member by moving away from its balancing position brings the magnet closer to or away from the switch.

In the case where a side movement of the rocking member closes up the circuits, it is advantageous for said member to have two magnets, each one being associated to a supple-blade knifeswitch placed on a joint electrical circuit, said switches being placed so as to form with the balancing position of their respective magnet angles of identical size but of reverse directions. With this arrangement, the device can work in either direction in which the sensor moves.

The number of yarns encountered is recorded by means which count up the variations in the oscillating states of the looped conductor. It is possible by calculating the difference with the number of spindles in the machine (difference which is calculated automatically) to find out how many yarns have broken for each machine examined.

Although the sensor can be secured to a movable member normally fitted on the textile machine (such as for example a pneumatic cleaner), it is also possible to provide special support and driving means.

Advantageously, the sensor is mounted on an endless belt passing over two pulleys, one of which at least is connected to a motor.

Advantageously, the motor is reversible and end-of-course contacts are provided at each end of the course followed by the sensor to reverse the rotation of the motor.

The invention will be more readily understood on reading the following description with reference to the accompanying drawings, in which:

FIG. 1 is a plan view of the detection system according to the invention.

FIG. 2 is a diagrammatical front view of the means driving the detection system.

Figure 3:
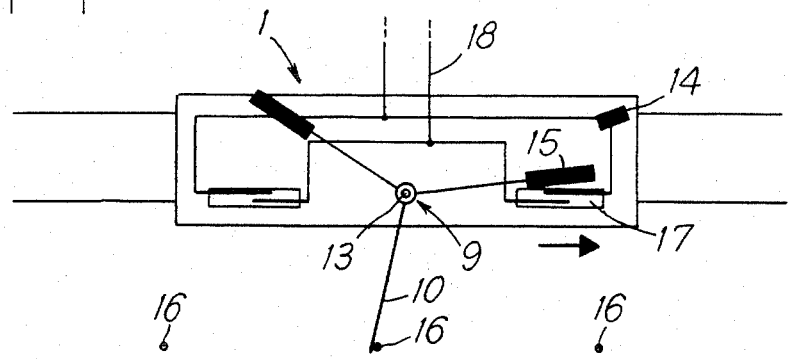
FIG. 3 is a schematic view of the sensor in an activating position.
Figure 4:
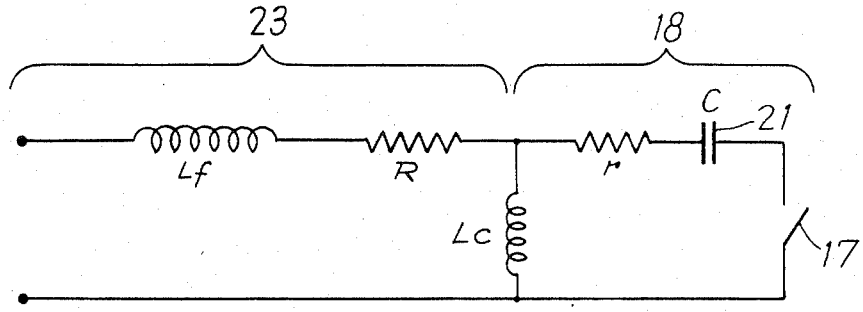
FIG. 4 is an electrical diagram corresponding to the detection device.

The device according to the invention comprises a movable sensor 1 adapted to move along a continuous spinning frame.

The sensor 1 is fixed to an endless belt 2. At one end of the frame, the belt 2 passes over a pulley 3 which is directly or indirectly driven by a reversible motor 4. At the other end of the frame, the belt passes over an idle return pulley 5.

Two guiding pulleys 6 can be provided to make the device more compact.

The belt 2 and/or the sensor 1 are guided over the entire length of the machine, by a double rail secured to the frame.

At each end of the rail 7, end-of-course contacts 8 reverse the rotation of the motor 4, via electrical connections not shown.

Instead of a reversible motor 4 driving the pulley 3, it is possible to use two motors capable of driving respectively pulleys 3 and 5, reciprocally in different directions.

The sensor 1 comprises a pivoting or rocking member 9 composed of three balanced horizontal rods 10, 11, 12, adapted to pivot about a vertical axle 13.

There is a balancing position for the rocking member 9, in which said member is restored by at least one fixed magnet 14 of the sensor, which magnet cooperates with one of the magnets 15 situated at the end of rods 11 and 12 of the rocking member.

The third rod 10, acting as a probing rod, extends substantially perpendicularly to the path of the sensor, when the rocking member is in a balancing position.

The assembly is so placed that, when the sensor 1 moves along the continuous spinning frame, the probing rod 10 can intercept the yarns 16 normally present on a continuous spinning frame.

The sensor 1 further comprises two flexible knife switches 17 adapted to close the same electrical circuit 18 composed of a conductor 19 wound around a cylindrical magnetic core 20, and optionally of a tuning condenser 21. The core 20 can be ferrite, imphy steel, or silicium sheet metal for example.

The means provided for convenying the data towards the stationary processing unit 22 comprises one or more looped conductors 23, a part 24 of which is kept substantially in parallel to the path follwed by the sensor 1 (i.e. parallel to the conveying rail 7) and extends over at least the whole length thereof. The magnetic cylinder 20 contains the conductor of the part 24 and is able to slide over the length corresponding ponding to the path folowed by the sensor 1.

The processing unit 22 comprises electronic means for generating oscillations in the looped conductor 23, and means for detecting variations in the oscillating conditions of said conductor.

These variations are induced by a change in the state of the electrical circuit 18 of the sensor 1, which corresponds to the closure of said circuit in response to a deviation of the rocking member caused by a yarn 16 being met on the path followed by the sensor 1 (or to be more precise on the path followed by the probing rod 10), as will be explained hereunder.

The sensor 1 driven by the belt 2 moves along the face of the continuous spinning frame at a speed between 15 and 20 meters per minute, the movement being reversed at each end of the machine.

When the probing rod 10 encounters a yarn 16, the rocking member 9 pivots clockwise (FIG. 3) or anticlockwise, depending on the moving direction of the sensor. One of the magnets 15 moves closer to a switch 17, thus closing up electrical circuit 18.

The return of the rocking member is ensured by the restoring magnet 14, the strength or preferably the position of which is adjustable (arrow 25) so that the strength required for pivoting the rocking member is very small and has no effect on the formation of the yarn 16.

The movable unit of the sensor composed of the magnetic circuit 20 and of the winding 19 constitutes a part of a transformer, the winding 19 constituting the secondary winding thereof.

The primary of this transformer is constituted by the conductor or conductors 24 stretched in parallel to the rail 7 and passing inside the magnetic circuit. Said primary winding is coupled to an oscillating circuit 26.

The short-circuit of the tuning condenser 21 or simply of the secondary winding 19 (short-circuit which corresponds to the closure of one of the switches 17) causes a variation in the oscillating conditions and in some cases their stoppage.

More specifically, if $L_f$ designates the inductance of the inductance-coil constituted by the cable 24 stretched along the frame and R its resistance, if $L_c$ designates the inductance of the coupling reactor of the torus 19-20 and C the capacity of the tuning condenser 21, the impedance $R_p$ brought back in parallel on the oscillating circuit 26 is expressed as:

$$R_p = \frac{1}{n^2}\left(R + \frac{X^2}{R}\right)$$

wherein designates the transformation ratio and X the reactance of the loop, with:

when the switch 17 is open, $X \simeq L_f\omega$. Therefore if R is very small in front of $L_f\omega$, $R_p$ is very high, when the switch 17 is closed, X tends to zero, and as a result $$R_p \cong \frac{R}{n^2}$$

R remaining low and $R_p$ strongly reducing.

To give an idea of value, $L_f$ is a few $\mu$H/m, R is a few $10^{-2}$ $\Omega$/m and $(\omega/2\pi)=50$ kHz. The tuning condenser C is about a few nF. The coupling between self primary and the loop 18 should be selected so as not to load the oscillating circuit when the swich 17 is open (Rp>1 k$\Omega$) and to obtain a small Rp (<100 $\Omega$) when the switch 17 is closed without having to resort to a sharp tuning. It is this impedance variation which entails the variation of the oscillating conditions. The torus 20 is obtained from two crucibles in ferrite used normally as magnetic casing for the reactors of television sets corrector circuits.

The coupling at the level of oscillating circuit 26 is also obtained from a crucible of the same type.

It should be noted that this solution enables to use several sensors on the same line and in particular enables the processing by the same assembly of two continuous faces.

The part played by the processing unit 22 is to count the number of closures of the switch 17, which corresponds to the number of yarns encountered on the course of the sensor.

The detection principle can be based on an assembly comprising two re-trippable monostables supplying, each time oscillations stop (therefore at each closure of the switch 17 or to be more precise of one of the two switches 17), descending fronts which only need to be calculated in a conventional manner.

The count-down counter is initialized everytime scanning starts, the initialized value corresponding to the number of yarns normally present on the continuous spinning frame. At end-of-scanning, the contents of the count-down counter thus indicate the number of broken yarns, said number can be stored, displayed and compared to a pre-determined critical threshold in relation to which any overranging value triggers a visual or sound alarm signal for example.

The processing unit 22 of course comprises dials and controls permitting to select the number of rods to be controlled in the loom, to display the number of broken yarns, to select the threshold of broken yarns beyond which an alarm is triggered, and to control the sensor driving motor.

Figure 5:
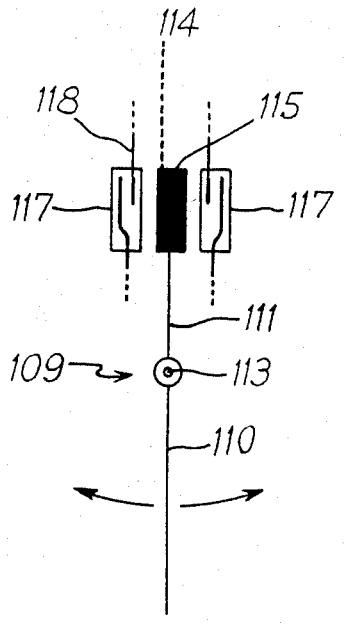
FIGS. 5 and 6 show two modifications of the rocking member of FIG. 1.
Figure 6:
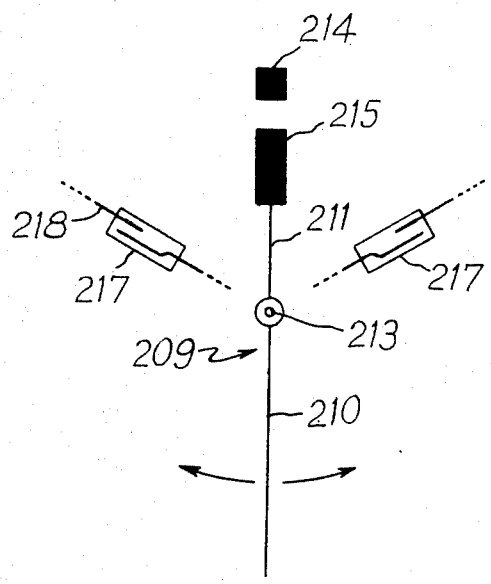

FIGS. 5 and 6 show two variant embodiments of the rocking member shown in FIG. 1.

In FIG. 5, the rocking member 109 is constituted of two opposite balancing rods: a probing rod 110 and a rod 111 provided at its end with a magnet 115, the rocking member being pivotable about the vertical axis 113.

The movable magnet 115 cooperates with a fixed identical bar magnet 114 placed just below or above the magnet 115 when the latter is in the median balancing position. The North pole of the magnet 114 is placed under the South pole of the magnet 115 and the South pole of the magnet 114 is below the North pole of the magnet 115, so that the fixed magnet 114 attracts the movable magnet 115 and restores same in its balancing position when it moves away therefrom, i.e. when the probing rod 110 has met up with a yarn. The magnet 115 when moving so in one direction or another, has been able to close one of the two supple-blade switches 117 of the electrical circuit 118 of the sensor movable unit.

This rocking member assembly is thus very compact and easy to miniaturize. Moreover, the restoring force exerted by the fixed magnet 114 on the movable magnet 115 is more efficient than in the preceding assembly due to the simultaneous action of the two poles of each magnet.

FIG. 6 shows a rocking member assembly which is very similar to that shown in FIG. 1 (the similar elements having the same reference numeral increased by 200), but wherein the rocking member only has two rods instead of three.

What is claimed is:

1. A system for detecting the presence of a yarn strand on a textile machine which comprises:

sensor means for detecting the presence of a yarn strand, said sensor means including a cylindrical-shaped magnetic core, an electric circuit including a conductor wound around said magnetic core and a switch to generate an electric signal in reponse to the presence of a yarn strand;

means for moving said sensor means across courses of yarn strands on said textile machine;

a fixed loop conductor including a leg portion traversing said cylingdrically-shaped magnetic core and disposed parallel to a path of movement of said sensor means;

means for generating oscillations in said looped conductor; and means for detecting a variation in oscillations in said looped conductor in response to said generated electric signal in said electric circuit.

2. The system as claimed in claim 1 wherein said electrical circuit includes a condenser.

3. The system as claimed in claim 2 wherein said means for detecting variations in oscillations comprises means for counting said variations in oscillations.

4. The system as claimed in claim 1 wherein said sensor means includes a rocking member pivotally mounted about an axis spaced apart and parallel to an axis of said courses of yarn strands, said rocking member comprising a sensing rod perpendicularly-disposed to said axes, said sensing rod being subject to the action of magnetic return means tending to return said sensing rod to a balanced position from which said sensing rod moves as a result of contact with a yarn strand during movement of said sensor means, said rocking member further comprising at least one magnet which cooperates with said switch, said switch, being a knife switch, equipped with flexible blades whereby slight movement of said sensing rod away from said balanced position causes a change of state of said electric circuit thereby indicating presence of a yarn strand.

5. The system as claimed in claim 4 wherein said electric circuit is closed when the sensing rod moves away from said balanced position.

6. The system as claimed in claim 4 wherein said rocking member is comprised of two magnets, each of said magnets being associated with a flexible knife switch in parallel in said electric circuit, said switch being disposed so as to form said balanced position with respective magnet of an angle of identical size a reverse direction.

7. The system as claimed in claim 4 wherein said rocking member comprises a movable bar magnet capable of being restored to said balanced position by a fixed bar magnet of reverse polarity superimposed on said movable bar magnet, said movable bar magnet being associated with said flexible blade switches situated on either side of said balanced position of said rocking member.

8. The system as claimed in claim 1 wherein said sensor means is mounted on an endless belt coursed over two pulleys, one of said pulleys being connected to a motor.

9. The system as claimed in claim 8 wherein said motor is reversible and said system further includes end-of-course contacts provided at each end of a course followed by a sensor switch to reverse rotation of said motor.

10. The system as claimed in claim 9 wherein said sensor switch is mounted on a movable unit normally provided on said textile machine.

* * * * *

UNITED STATES PATENT AND TRADEMARK OFFICE

CERTIFICATE OF CORRECTION

PATENT NO. : 4,525,705

DATED : June 25, 1985

INVENTOR(S) : Jacques Edmé and Etienne Deffontaine

It is certified that error appears in the above-identified patent and that said Letters Patent is hereby corrected as shown below:

Col. 4, line 23, "$\cong$" should read -- $\simeq$ --.

Claim 1, lines 4-5, "cylindrical-shaped" should read -- cylindrically-shaped --.

Signed and Sealed this

*Fifteenth* Day of *October 1985*

[SEAL]

*Attest:*

*Attesting Officer*

DONALD J. QUIGG

*Commissioner of Patents and Trademarks—Designate*